US006954058B2

(12) United States Patent
Ota et al.

(10) Patent No.: US 6,954,058 B2
(45) Date of Patent: Oct. 11, 2005

(54) CONSTANT CURRENT SUPPLY DEVICE

(75) Inventors: Kingo Ota, Nishio (JP); Shoichi Okuda, Nukata-gun (JP)

(73) Assignee: Denso Corporation, Kariya (JP)

( * ) Notice: Subject to any disclaimer, the term of this patent is extended or adjusted under 35 U.S.C. 154(b) by 25 days.

(21) Appl. No.: 10/795,323

(22) Filed: Mar. 9, 2004

(65) Prior Publication Data

US 2004/0183515 A1 Sep. 23, 2004

(30) Foreign Application Priority Data

Mar. 18, 2003 (JP) ..... 2003-073898
Nov. 26, 2003 (JP) ..... 2003-395571

(51) Int. Cl.[7] ..... G05F 3/16
(52) U.S. Cl. ..... 323/315
(58) Field of Search ..... 323/313, 314, 323/315

(56) References Cited

U.S. PATENT DOCUMENTS 4,088,941 A * 5/1978 Wheatley, Jr. ..... 323/226
6,087,821 A 7/2000 Kojima

FOREIGN PATENT DOCUMENTS

| | | |
|---|---|---|
| JP | A-2000-124743 | 4/1912 |
| JP | A-5-35352 | 2/1993 |
| JP | A-2002-91589 | 3/2002 |
| JP | A-2002-236521 | 8/2002 |

* cited by examiner

*Primary Examiner*—Shawn Riley
(74) *Attorney, Agent, or Firm*—Posz Law Group, PLC

(57) ABSTRACT

In a current mirror circuit, a compensation resistor having a positive temperature coefficient is connected between the source of a MOS transistor and a power supply line. When the temperature rises, a current output by the constant current circuit and a current flowing through the drain of the MOS transistor decrease. Since the resistance of the compensation resistor increases, however, a voltage between the gate and source of another MOS transistor can be prevented from declining due to the decrease in the drain current so that an electric potential at the gate of a further MOS transistor, hence, a main current, can be prevented from fluctuating. In addition, a constant current output circuit is configured to shunt a feedback control current thereby to adjust an output current of each channel.

18 Claims, 12 Drawing Sheets

CONSTANT CURRENT SUPPLY DEVICE

CROSS REFERENCE TO RELATED APPLICATION

This application is based on and incorporates herein by reference Japanese Patent Applications No. 2003-73898 filed on Mar. 18, 2003 and No. 2003-395571 filed on Nov. 26, 2003.

FIELD OF THE INVENTION

The present invention relates to a constant current supply device for controlling a current flowing through a main transistor to a constant value. The present invention also relates to a constant current supply device having a plurality of constant current output circuits.

BACKGROUND OF THE INVENTION

Various constant current circuits have been proposed. A constant current circuit disclosed in JP-A-5-35352 has an emitter-follower transistor for generating an output current and a parallel circuit connected to the emitter of the transistor. The parallel circuit comprises a diode and a resistor having a positive temperature coefficient. A current source circuit disclosed in JP-A-2000-124743 has a current mirror constant current circuit serving as a first constant current source circuit as well as second and third constant current source circuits connected between a power supply line and transistors forming the current mirror constant current circuit. A resistor having a negative temperature coefficient is connected between the power supply line and each of transistors composing the second and third constant current source circuits.

A constant current circuit disclosed in JP-A-2002-236521 has a voltage generation circuit and a constant current supply device. The voltage generation circuit has a reference voltage circuit and a temperature characteristic correction circuit connected to the reference voltage circuit as a circuit for correcting the temperature characteristic of the reference voltage circuit. The constant current supply device is a circuit for controlling a current, which is generated by a voltage output by the reference voltage circuit with its temperature characteristic corrected as a current flowing through an internal current detection resistor. The internal current detection resistor has the temperature characteristic opposite to the temperature characteristic of the reference voltage circuit employed in the voltage generation circuit.

A circuit shown in FIG. 12 is proposed as another constant current supply device 1. The constant current supply device 1 controls a main current IL flowing through a main current path 4 to a constant magnitude. The main current path 4 is a path starting from a terminal 2, passing through a resistor R1 for detecting a current flowing through the resistor R1, a MOS transistor Q1 and a resistor R2, and ending at a terminal 3. A voltage appearing between the two ends of the resistor R1 varies in accordance with the main current IL, changing a current flowing through the collector of a transistor Q3 in a current mirror circuit 5, which comprises a transistor Q2, the transistor Q3 and resistors R1, R2 and R3.

A transistor Q4 is connected between the collector of the transistor Q3 and a power supply line 6 linked to a terminal 3. The transistor Q4 and a transistor Q5 form a current mirror circuit 7. A self-bias constant current circuit 9 using a voltage appearing between the base and the emitter as a reference voltage is connected between the transistor Q2 and the power supply line 6. On the other hand, a self-bias constant current circuit 10 using a voltage appearing between the base and the emitter as a reference voltage is connected between the transistor Q5 and a power supply line 8.

In this constant current supply device 1, when the main current IL exceeds a target current magnitude, for example, the voltage appearing between the two ends of the resistor R1 also exceeds a predetermined level, increasing a voltage appearing between the base and emitter of the transistor Q3. Thus, a current flowing through the collector of the transistor Q3 also rises as well. As a result, the electric potential appearing at the gate of the transistor Q1 decreases, causing feedback control to operate to result in a decrease in the main current IL.

In this constant current supply device 1, however, when the current output by the constant current circuit 9 changes due to, among other causes, a change in temperature, the change in the output current causes currents flowing through the transistors Q2, Q3, Q4 and Q5 to change as well. As a result, the electric potential appearing at the gate of the transistor Q1 also changes, causing the main current IL to deviate from the target current magnitude.

In this case, when the constant current circuits 9 and 10 are in a state of being associated with each other by a current mirror circuit not shown in the figure, the current flowing through the transistor Q5 exhibits the same trend of changes caused by changes in temperature as the current output by the constant current circuit 10. Thus, the magnitude of the change in main current IL is reduced. In actuality, however, the resistances of the resistors R1 to R3 also change. Therefore, when the operating temperature changes from −40 degrees Celsius to 145 degrees Celsius, the main current IL changes by about 200 mA from a target current magnitude of 1.5 A as shown in FIG. 2B. In this case, by designing each of the constant current circuits 9 and 10 into a circuit configuration using a band gap reference, the magnitude of the change can be reduced. However, the circuit configuration becomes complicated.

In the case of another typical constant current circuit using a constant current as a bias current, a current output by the circuit is detected as a voltage appearing between the two ends of a resistor, and changes of the detected voltage are fed back as changes of a voltage appearing between the base and emitter of a transistor. This constant current is generated on the basis of a reference voltage generated by a reference voltage generation circuit.

A reference voltage generation circuit disclosed in JP-A-2000-112548 generates a high precision reference output voltage slightly lower than the electric potential of the power supply by fine adjustment of the resistance of a resistor device in a laser trimming process. In JP-A-2002-091589, after IC resin encapsulation, trimming adjustment of a resistor can be carried out to optimize the temperature characteristic of the reference voltage.

In addition, as shown in FIG. 13, an IC 201 comprising a plurality of constant current output circuits 202 has also been proposed. The constant current output circuits 202 each operate by receiving a battery voltage VMAIN supplied by power supply lines 203 and 204. In spite of variations in the battery voltage VMAIN, the IC 201 outputs a constant current to every load RL connected to one of terminals 205 of the IC 201. Each of the constant current output circuits 202 comprises transistors Q201 to Q205, resistors R201 to R205 as well as constant current circuits 206 and 207. The resistor R201 is a current detection resistor and the transistor Q203 is an output transistor.

When the current flowing through a load RL connected to the constant current output circuit 202 exceeds a set target magnitude, a voltage appearing between the two ends of the resistor R201 increases and, hence, the current flowing through the collector of the transistor Q202 increase while a voltage appearing between the gate and source of the transistor Q203 decreases. As a result, the current flowing through the drain of the transistor Q203 decreases, exhibiting an effect of restoring the current flowing through the load RL to the set target magnitude.

When an A1 shunt resistor and an LDMOS transistor are used respectively as the resistor R201 and the transistor Q203 in the constant current output circuit 202, the temperature coefficient of the resistor R201 is about equal to that of the transistor Q203. Thus, changes in current, which are caused by changes in temperature, are compensated for to a certain degree. In order to obtain a high precision constant current output characteristic, coordinated current adjustment needs to be performed by carrying out adjustment works such as a laser trimming process for the resistor R204 and a trimming process for the transistors Q201 and Q202 for every constant current output circuit 202.

Except for a case in which a constant current output circuit 202 is embedded in the IC 201 as 1 channel, as the number of channels rises, the size of a circuit for trimming process use and the time it takes to carry out the trimming process increases as well. As a result, the manufacturing cost also rises.

SUMMARY OF THE INVENTION

It is thus a first object of the present invention to provide a constant current supply device, that has a constant current circuit for generating a constant current for a bias on the basis of a voltage appearing between a base and emitter of a transistor and is capable of reducing changes in controlled current, which are caused by changes in temperature.

It is a second object of the present invention to provide a constant current supply device that considerably prevents the size thereof from increasing and allows a current generated by each of a plurality of constant current output circuits included therein to be adjusted with ease.

In a constant current supply device provided by the present invention, a controlled current, which is a main current subjected to constant current control, flows through a main current path starting from a current output terminal, passing through a resistor for current detection as well as a main transistor and ending at a first power supply line. The main current is detected as a voltage appearing between the two ends of the resistor for current detection. This voltage is applied between the base and emitter of a second transistor employed in a first current mirror circuit. A current flowing through the second transistor flows into a second current mirror circuit. An electric potential appearing at the base of the main transistor is determined on the basis of a current output by the second current mirror circuit and a current output by a second constant current circuit.

When the main current exceeds a target current magnitude, for example, the voltage appearing between the two ends of the resistor for current detection, that is, the voltage applied between the base and emitter of the second transistor, also increases, tending to raise the current flowing through the collector of the second transistor and, hence, a current output by the second current mirror circuit. As a result, the constant current supply device exhibits an effect of reducing the electric potential appearing at the base of the main transistor and the main current. Through this negative feedback control, the main current is controlled to a constant value.

The first constant current circuit works by taking a voltage appearing between the base and emitter of a transistor as a reference voltage. Thus, when the temperature increases, the output current generated by the first constant current circuit decreases in accordance with a temperature coefficient of −2 mV/degrees Celsius for the voltage appearing between the base and the emitter. Since the first constant current circuit is a circuit for supplying a reference bias current to the first transistor, the decrease in output current reduces a current output by the second current mirror circuit. Thus, the electric potential appearing at the base of the main transistor increases. As a result, the main current rises, exceeding the target current magnitude.

In the second current mirror circuit, on the other hand, a first compensation resistor having a positive temperature coefficient is provided between a first power supply line and the emitter of a third transistor through which the current flowing through the collector of a second transistor flows. This configuration suppresses decreases of a voltage appearing between the base and emitter of a third transistor, decreases of a voltage appearing between the base and emitter of a fourth transistor and, hence, decreases of a current output by the second current mirror circuit. As a result, changes of the electric potential appearing at the base of the main transistor can be suppressed even when the temperature changes so that the main current can be controlled to a value equal to the target current magnitude.

In addition, for each constant current output circuit in the constant current supply device provided by the present invention, the current flowing through the third transistor serving as an output transistor is converted into a voltage appearing between the two ends of a current detection resistor connected in series to the third transistor. When an output current output from a current output terminal, that is, the current flowing through the third transistor, exceeds a predetermined target current magnitude, for example, a voltage appearing between the base and emitter of the second transistor, hence, the current flowing through the collector of the second transistor, increases, causing a feedback control circuit to reduce a voltage appearing between the gate and source of the third transistor. As a result, the output current is restored to the predetermined target current magnitude by control to adjust the current to a constant value.

In addition, the output current adjustment circuit has a fourth transistor, through which a portion of a feedback current flows, for each of the constant current output circuits. The feedback current is a current flowing through the second transistor. The currents flowing through the fourth transistors of the constant current output circuits are controlled as a common single quantity in an aggregated manner instead of changing the currents individually. Thus, the aggregated current adjustment can be carried out with ease for the constant current output circuits and the time it takes to adjust the currents can also be shortened. In addition, components such as a trimming resistor are not needed for each of the constant current output circuits.

It is to be noted that the first to fourth transistors can each be a bipolar transistor or a FET or implemented as a bipolar circuit, a CMOS circuit, a BiCMOS circuit or the like. The above portion of a current flowing through the second transistor can be obtained by splitting the current flowing into the second transistor at the stage before the current flows into the second transistor or at the stage after the current flows out from the second transistor.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE PREFERRED EMBODIMENTS (First Embodiment)

Figure 1:
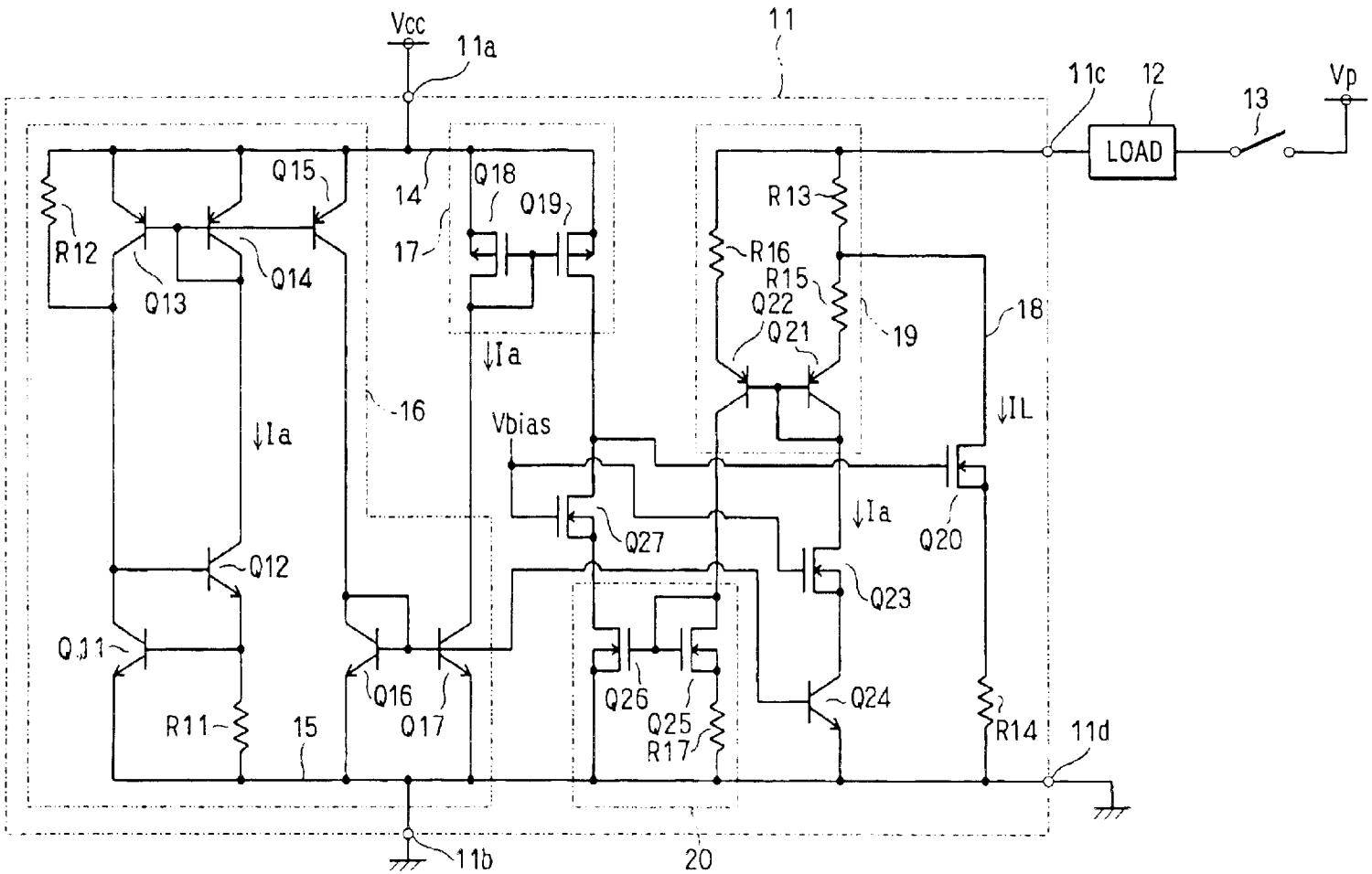
FIG. 1 is an electric circuit diagram showing a constant current supply device implemented by a first embodiment of the present invention.

A constant current supply device 11 shown in FIG. 1 is an integrated circuit (IC) used typically for driving an airbag of an automobile. Terminals 11*a* and 11*b* of the IC 11 are each a power supply terminal. A power supply voltage Vcc of typically 25V is applied between the terminals 11*a* and 11*b*. A terminal 11*c* of the IC 11 is a current output terminal connected to one end of a load 12, the other end of which is connected to a voltage boosting power supply through a high-side switch circuit 13.

The voltage boosting power supply is for supplying a power supply voltage of typically 35V to the load 12 by way of the high-side switch circuit 13. The load 12 is a load to be borne in driving the airbag. The high-side switch circuit 13 is a semiconductor switching device. A terminal 11*d* of the IC 11 is the ground terminal of a power system supplying power to the terminal 11*c*. The constant current supply device 11 controls a current, which is flowing to the load 12 when the high-side switch circuit 13 is closed, to a constant magnitude of typically 1.5 A.

A self-bias constant current circuit 16 for generating a constant current Ia is connected between a power supply line 14 (second power supply line) wired to the terminal 11*a* and a power supply line 15 (first power supply line) linked to the terminals 11*b* and 11*d*. The constant current circuit 16 uses a voltage appearing between the base and emitter of a NPN-type transistor Q11 as a reference voltage. Transistors composing the constant current circuit 16 are all bipolar transistors. A resistor R11 is connected between the base and emitter of the transistor Q11 as a resistor for determining a current magnitude. The base and collector of the transistor Q11 are connected respectively to the emitter and base of a transistor Q12.

A current mirror circuit comprising transistors Q13 and Q14 is connected between the power supply line 14 and the collectors of the transistors Q11 and Q12. A resistor R12 is connected between the emitter and collector of the transistor Q13 as a resistor for activation. Transistors Q15 and Q16 are connected to each other in series between the power supply lines 14 and 15. One of these transistors, i.e., the transistor Q15, forms a current mirror circuit in conjunction with a transistor Q14. On the other hand, the transistor Q16 forms a current mirror circuit in conjunction with a transistor Q17.

A current mirror circuit 17 receives the constant current Ia generated by the constant current circuit 16 and outputs the constant current Ia as it is. The current mirror circuit 17 comprises MOS transistors Q18 and Q19, the sources of which are connected to the power supply line 14. The constant current circuit 16 and the current mirror circuit 17 form a second constant current circuit.

A resistor R13 (current detection resistor), an N-channel LDMOS transistor Q20 (main transistor) and a resistor R14 (feedback resistor) are connected in series between the terminals 11*c* and 11*d* to form a main current path 18. A current mirror circuit 19 (first current mirror circuit) is a circuit inputting a constant bias current (reference current) serving as a reference and outputting a current corresponding to the reference current and the main current IL flowing through the resistor R13. In this embodiment, the reference current is equal to the constant current Ia output from the constant current circuit 16, and the current mirror circuit 19 functions as a current detection device for outputting a current varying in accordance with changes in main current IL.

The current mirror circuit 19 comprises PNP-type transistors Q21 and Q12 (first and second transistors respectively), a resistor R15 (first resistor) and a resistor R16 (second resistor). The bases of the transistors Q21 and Q12 are connected to each other. The resistor R15 is connected between the emitter of the transistor Q21 and the resistor R13. The resistor R16 is connected between the emitter of the transistor Q22 and the terminal 11*c*. In this configuration, since the resistors R13, R15 and R16 are each an aluminum wire resistor, the chip area occupied by each of the resistors can be reduced.

The base and collector of the transistor Q2 are connected to each other. A MOS transistor Q23 and a NPN-type transistor Q24 are connected in series between the collector of the transistor Q21 and the power supply line 15. The base of one of the transistors, i.e., the transistor Q24, is connected to the bases of the transistors Q16 and Q17, which are employed in the constant current circuit (the first constant current circuit) flowing the constant current Ia. The MOS transistor Q23 has a function to fix an electric potential appearing at the collector of the transistor Q24. A bias voltage Vbias is supplied to the gate of the transistor Q23.

A MOS transistor Q25 (third transistor) and a resistor R17 (first compensation resistor) having a positive temperature coefficient are connected to each other in series between the collector of the transistor Q22 and the power supply line 15 respectively. To be more specific, the drain and source of the transistor Q25 are connected to the resistor R17 and the transistor Q22 respectively. The gate and source of a MOS transistor Q26 (fourth transistor) are connected to the gate of the transistor Q25 and the power supply line 15 respectively. The MOS transistors Q25 and Q26 form a current mirror circuit 20 (second current mirror circuit) in conjunction with the resistor R17.

A MOS transistor Q27 is connected between the drain of the transistor Q26 and the drain of the transistor Q19. As with the transistor Q23, the transistor Q27 has a function to fix an electric potential appearing at the drain of the transistor Q26. The bias voltage Vbias is applied to the gate of the transistor Q27. The drains of the MOS transistors Q19 and Q27 are connected to the gate of a MOS transistor Q20.

Figure 2A:
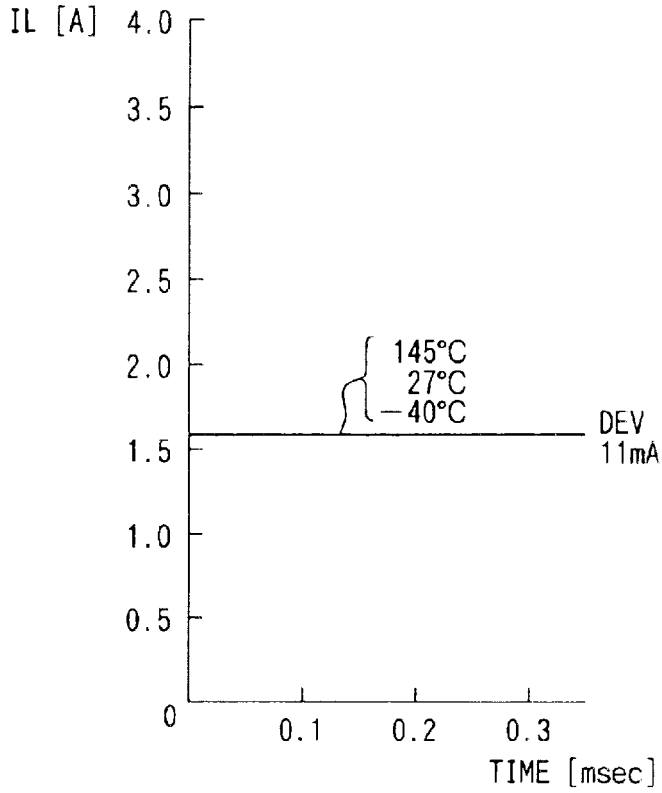
FIGS. 2A and 2B are diagrams showing simulation waveforms of a main current for a case in which junction temperatures of transistors are changed.
Figure 2B:
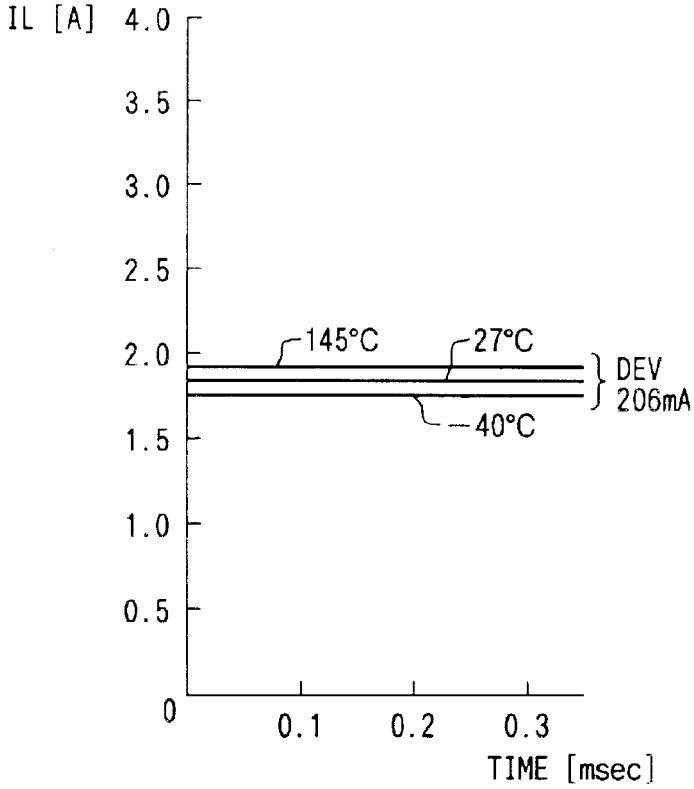
FIG. 2B RELATED ART
Figure 3:
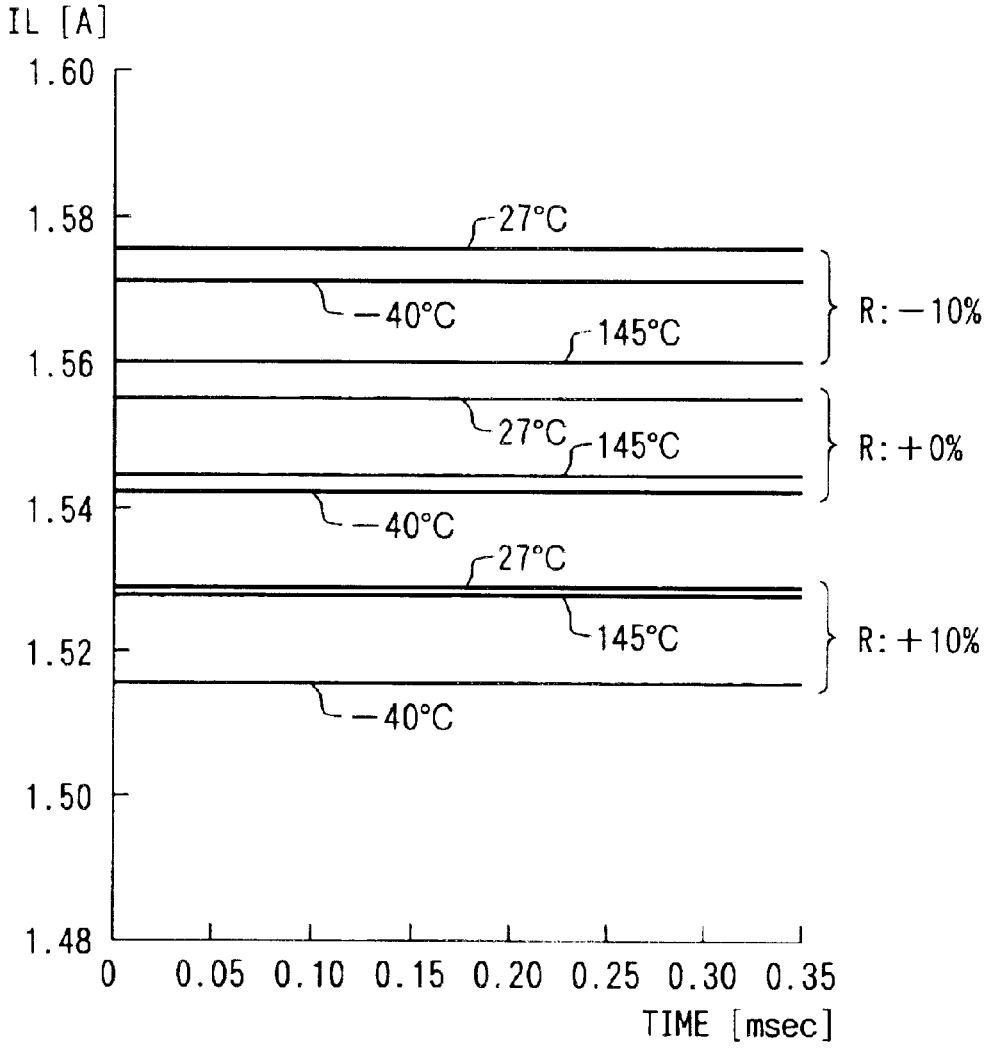
FIG. 3 is a diagram showing simulation waveforms of the main current for a case in which resistances are changed by +10% or −10%.

Next, effects of this embodiment are explained by referring to FIGS. 2A, 2B and 3.

In the basic operation of the constant current supply device 11, when the power supply voltage Vcc is applied to the IC 11 with the high-side switch circuit 13 turned off, the constant current supply device 16 outputs the constant current Ia, which is determined by a quotient obtained by dividing a voltage VBE appearing between the base and emitter of the transistor Q11 by the resistance of the resistor R11. The constant current Ia flows through the MOS transistors Q18 and Q19. Since the high-side switch circuit 13 is in the turned-off state, on the other hand, the MOS transistors Q25 and Q26 are also in the turned-off state as well so that the electric potential appearing at the gate of the transistor Q20 rises to a level close to the power supply voltage Vcc.

When a driving signal is received from an ECU (electronic control unit, not shown in the figure) in this state, the high-side switch circuit 13 is turned on, allowing the main current IL to flow from the voltage boosting power supply (not shown) in the figure through the high-side switch circuit 13, the load 12, the terminal 11*c*, the resistor R13, the transistor Q20, the resistor R14 and the terminal 11*d*. As the main current IL flows, a voltage determined by the magnitude of the main current IL appears between the two ends of the resistor R13 and is fed back to the transistor Q20 as follows. Changes of the voltage appearing between the two ends of the resistor R13 result in changes of a voltage appearing between the base and emitter of the transistor Q22.

In turn, the changes of the voltage appearing between the base and emitter of the transistor Q22 cause changes of the current flowing through the collector of the transistor Q22. In turn, the changes of the current flowing through the collector of the transistor Q22 result in changes of currents flowing through the drains of the MOS transistors Q25 and Q26. Finally, the changes of the currents flowing through the drains of the MOS transistors Q25 and Q26 appear as changes of a voltage applied to the base of the transistor Q20.

It is assumed for example that the main current IL is controlled to a target current magnitude of 1.5 A at a constant temperature. It is assumed that the main current IL decrease due to an external disturbance. In this case, the voltage appearing between the two ends of the resistor R13 also decreases, reducing the current flowing through the collector of the transistor Q22 and the current flowing through the drain of the transistor Q25. Since the MOS transistors Q25 and Q26 form the current mirror circuit 20, a voltage appearing between the gate and source of the transistor Q26 also decreases.

On the other hand, the transistor Q19 connected in series to the transistor Q26 forms the current mirror circuit 17 in conjunction with the transistor Q18, making an attempt to flow the constant current Ia. Thus, the voltage applied to the gate of the transistor Q20 rises. That is, when the main current IL deviates from the target current magnitude of 1.5 A, a negative feedback effect blocks the deviation DEV of the main current IL from the target current magnitude. As a result, the main current IL is controlled to the constant target current magnitude.

Next, operations accompanying a change in IC temperature are explained. It is assumed for example that the temperature of the IC 11 rises. In this case, the voltage VBE appearing between the base and emitter of the transistor Q11 decreases at a rate of −2 mV/degrees Celsius so that the constant current Ia also drops. Thus, the current flowing through the transistor Q24 and, hence, the current flowing through the transistor Q21 also become smaller as well. As the current flowing through the transistor Q21 falls, a voltage appearing between the two ends of the resistor R15 also becomes lower, reducing the current flowing through the collector of the transistor Q22 and the current flowing through the drain of the transistor Q25 in the same way as the case in which the main current IL is reduced.

In the case of the conventional configuration not including the resistor R17, when the current flowing through the collector of the transistor Q22 decreases, the voltage applied to the gate of the transistor Q20 increases, causing a problem of the main current IL exceeding the target current magnitude.

In the case of this embodiment including the resistor R17 connected between the transistor Q25 and the power supply line 15 as a resistor having a positive temperature coefficient, on the other hand, when the temperature increases, the resistance of the resistor R17 also rises, preventing the voltage applied between the gate and source of the transistor Q26 from decreasing even when the current flowing through the drain of the transistor Q25 becomes smaller due to the increase in temperature.

As a result of this compensation for the increase in temperature, a rise in the main current IL caused by the increase in temperature can be suppressed. In actuality, the current output by the current mirror circuit 17 also decreases due to the increase in temperature. Thus, the resistance and positive temperature coefficient (>0) of the resistor R17 must be determined by evaluating all these factors collectively.

Figure 12:
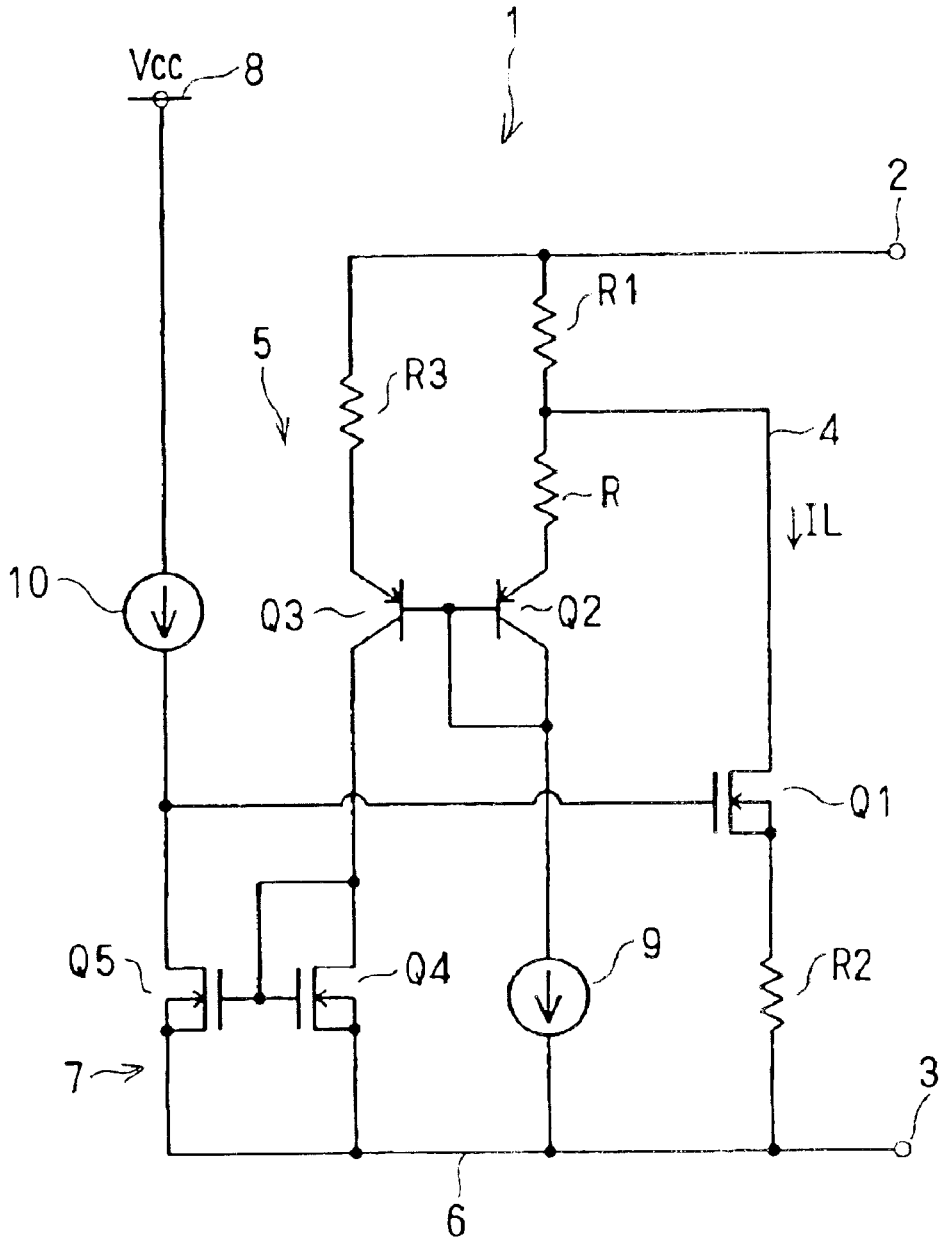
FIG. 12 RELATED ART
FIG. 12 is an electric circuit diagram showing a constant current supply device according to one related art.
Figure 13:
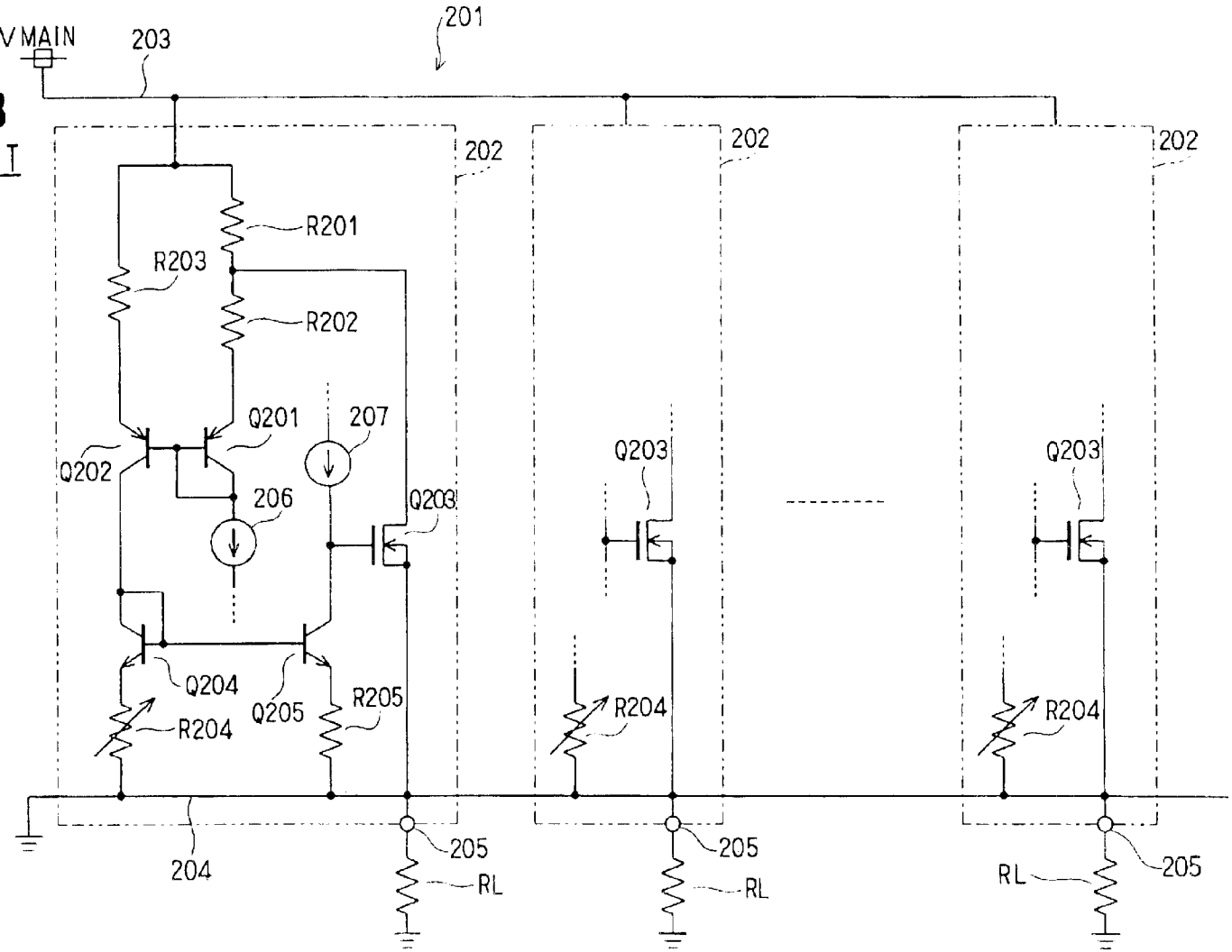
FIG. 13 RELATED ART
FIG. 13 is an electric circuit diagram showing a constant current supply device according to another related art.

FIGS. 2A and 2B are diagrams each showing a simulation waveform of the main current IL for a case in which the junction temperatures of transistors composing the IC 11 are set at −40, 27 and 145 degrees Celsius. To be more specific, FIG. 2A is a diagram showing a simulation waveform for the first embodiment including the resistor R17. On the other hand, FIG. 2B is a diagram showing simulation waveforms for a case not including the resistor R17 as shown in FIG. 12. FIG. 3 is a diagram showing a simulation waveform of the main current IL for a case in which the resistance R of the resistor R17 is changed from a predetermined value by +10% or −10%. This simulation waveform is used as a waveform for studying effects of dispersions of the resistance R.

A comparison of FIG. 2A with FIG. 2B indicates that, while FIG. 2B reveals a difference of 206 mA between the main current IL at a junction temperature of −40 degrees Celsius and the main current IL at a junction temperature of 145 degrees Celsius, a difference shown in FIG. 2A for the constant current supply device 11 implemented by the first embodiment as a difference between the main current IL at the junction temperature of −40 degrees Celsius and the main current IL at the junction temperature of 145 degrees Celsius can be suppressed to 11 mA. As understood from FIG. 3, by adding the resistor R17, the magnitude of the change in main current IL caused by a change in temperature can be reduced to about 1/18 times.

In addition, as shown in FIG. 3, when tolerance in the range ±10% is allowed for the resistance R of the resistor R17 as tolerance caused by dispersions of manufacturing of the resistor R17, few dispersions of the main current IL with respect to the target current magnitude result. In this case, nevertheless, changes in the main current IL, which are caused by changes in temperature for each value of the resistance R, never exceed a maximum of 17 mA. As is obvious from this data, this means turns out to be compensation also suitable for the manufacturing of actual ICs. It is to be noted that, when the resistance R of the resistor R17 is adjusted, the magnitude of the dispersion with respect to the target current magnitude and the magnitude of the change in main current IL caused by a change in temperature can be further reduced.

As described above, the current mirror circuit 20 employed in the constant current supply device 11 implemented by the first embodiment includes the resistor R17 connected between the power supply line 15 and the source of the transistor Q25, through which the collector current of the transistor Q22 is flowing, as a resistor having a positive temperature coefficient. Thus, even when the temperature changes, causing the current Ia output by the constant current circuit 16 and, hence, the current flowing through the collector of the transistor Q22 also to vary, the voltage applied between the gate and source of the transistor Q25 as well as the voltage applied between the gate and source of the transistor Q26 can be prevented from changing so that the electric potential appearing at the gate of the transistor Q20 and, hence, the main current IL can also be prevented from varying as well.

The electric potential appearing at the gate of the transistor Q20 is determined in accordance with the current output by the current mirror circuit 17 and the current output by the current mirror circuit 20. In addition, the current mirror circuit 17 and the current mirror circuit 20 are each designed into a configuration for outputting a current based on the current Ia output by the constant current circuit 16. Thus, when the temperature changes, the effect of a change in output current Ia is nullified. As a result, the change in main current IL can be further reduced.

In addition, the resistor R14 for feedback is provided between the source of the transistor Q20 and the power supply line 15. Since the resistor R14 performs a negative feedback control of the main current IL, the resistor R14 contributes to operations to make the IL constant as well as stable. In addition, the resistor R14 also exhibits an effect of protecting the transistor Q20 in case an excessively large main current IL flows.

The current mirror circuit 19 includes the resistors R15 and R16 in addition to the resistor R13 for current detection use. Thus, by setting the resistances of the resistors R13, R15 and R16 at proper values, the current mirror circuit 19 can be driven to operate in a desired bias state. In addition, since the resistors R13, R15 and R16 are each an aluminum wire resistor, the IC chip areas can be reduced. The IC chip areas are areas in the IC, which are occupied by the resistors R13, R15 and R16. As a result, the manufacturing cost can also be decreased as well.

(Second Embodiment)

Figure 4:
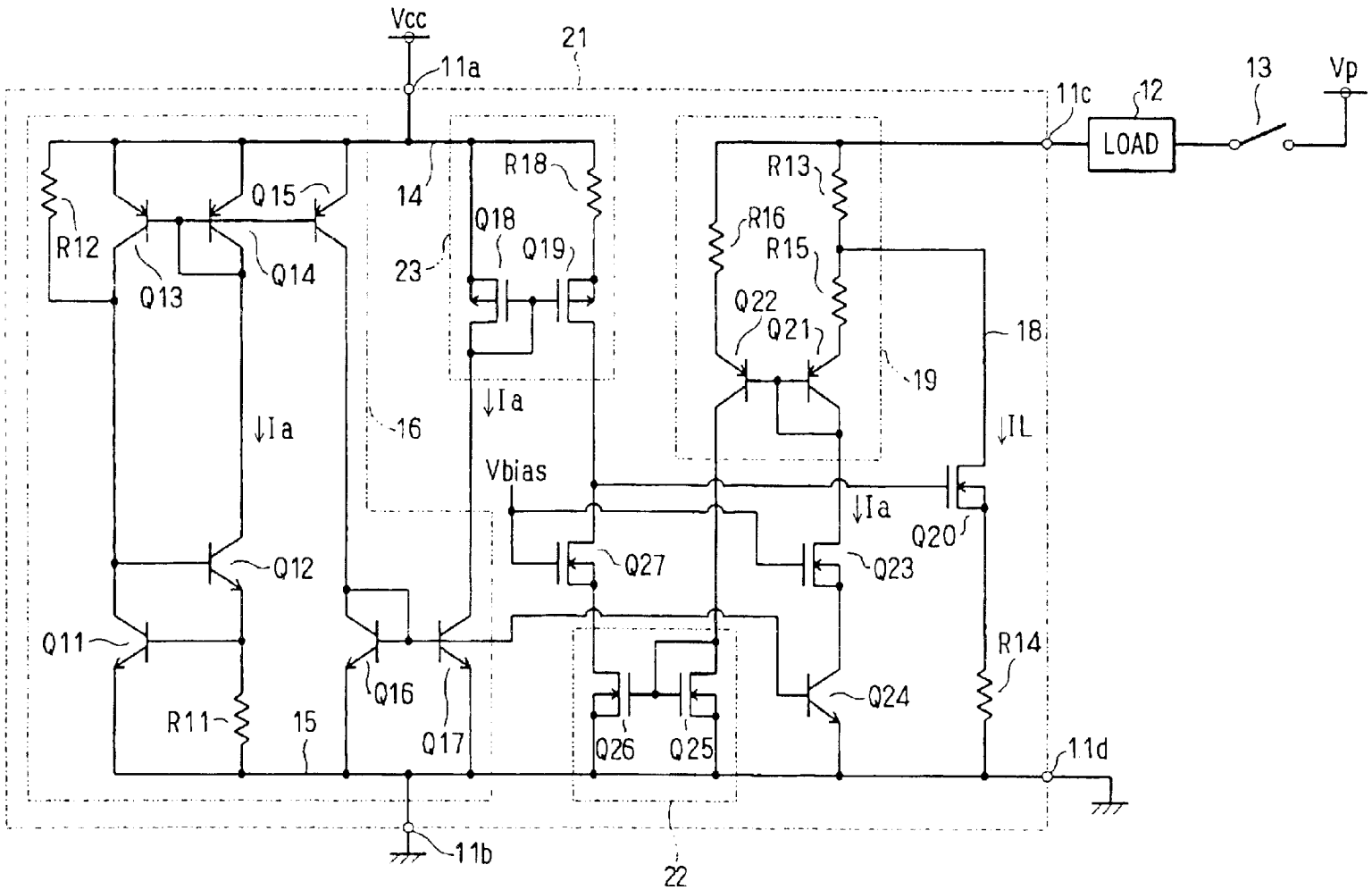
FIG. 4 is an electric circuit diagram showing a constant current supply device implemented by a second embodiment of the present invention.

A constant current supply device 21 shown in FIG. 4 is different from the constant current supply device 11 shown in FIG. 1 in that the constant current supply device 21 includes a resistor R18 (second compensation resistor) connected between the power supply line 14 and the source of the transistor Q19 to serve as a substitute for the resistor R17. The resistor R18 also has a positive temperature coefficient. In this case, the MOS transistors Q25 and Q26 form a current mirror circuit 22 (second current mirror circuit), whereas the MOS transistors Q18 and Q19 (fifth and sixth transistors) form a current mirror circuit 23 (third current mirror circuit) in conjunction with a resistor R18. It is to be noted that a constant current circuit 16 corresponds to a third constant current circuit.

In this configuration, it is assumed for example that the temperature of the IC 21 rises, causing the constant current Ia to decrease. In this case, the magnitudes of the currents flowing through the drains of MOS transistors Q25 and Q26 become smaller as in the first embodiment. On the other hand, since the resistance of the resistor R18 increases, however, a current output by the current mirror circuit 23 also decreases, suppressing changes of the electric potential appearing at the gate of the transistor Q20.

Figure 5:
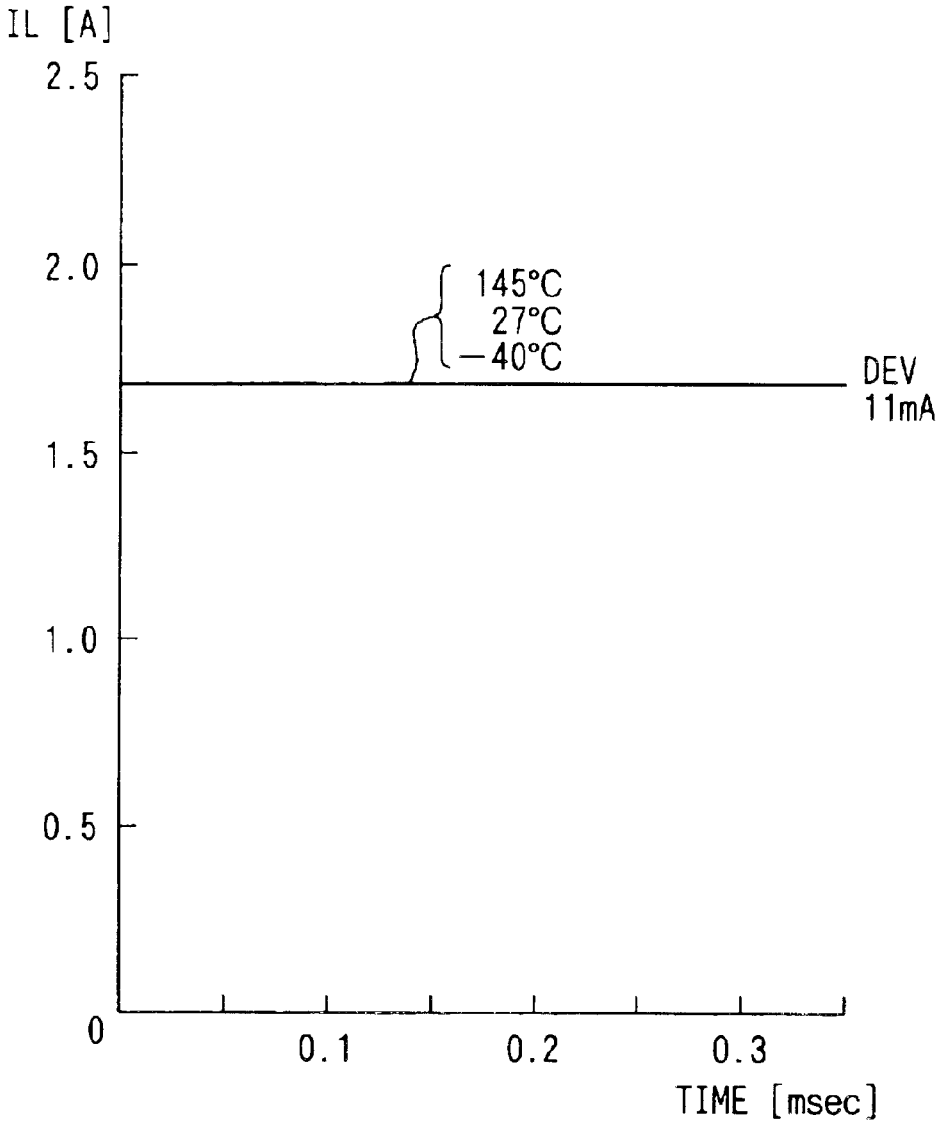
FIG. 5 is a diagram showing a simulation waveform of a main current for the second embodiment.

FIG. 5 is a diagram showing a simulation waveform of the main current IL for a case in which the junction temperatures of transistors composing the IC 21 are set at −40, 27 and 145 degrees Celsius. The constant current supply device 21 implemented by this embodiment shows that a difference between the main current IL at a junction temperature of −40 degrees Celsius and the main current IL at a junction temperature of 145 degrees Celsius can be suppressed to a value not greater than 10 mA. In this way, this embodiment exhibits the same effects as the first embodiment.

For example, the first and second embodiments described above can be changed or extended as follows.

The constant current circuit 16 may be configured for generating a constant current on the basis of a voltage VBE applied between the base and emitter of a bipolar transistor. Transistors employed in other portions can be bipolar transistors only, FETs only or bipolar transistors used with FETs.

The resistors R17 and R18 employed in the first and second embodiments respectively may also both be used.

The MOS transistors Q18 and Q19 forming the current mirror circuit 17 as well as the transistor Q24 all have a configuration for flowing the constant current Ia generated by the constant current circuit 16. However, they may also have different configurations for flowing constant currents generated by constant current circuits different from each other.

The MOS transistors Q23 and Q27 may be provided only when they are needed.

The constant current supply devices 11 and 21 are capable of executing constant current control even when a resistor, a solenoid, a relay coil or another component is connected as the load 12.

(Third Embodiment)

Figure 6:
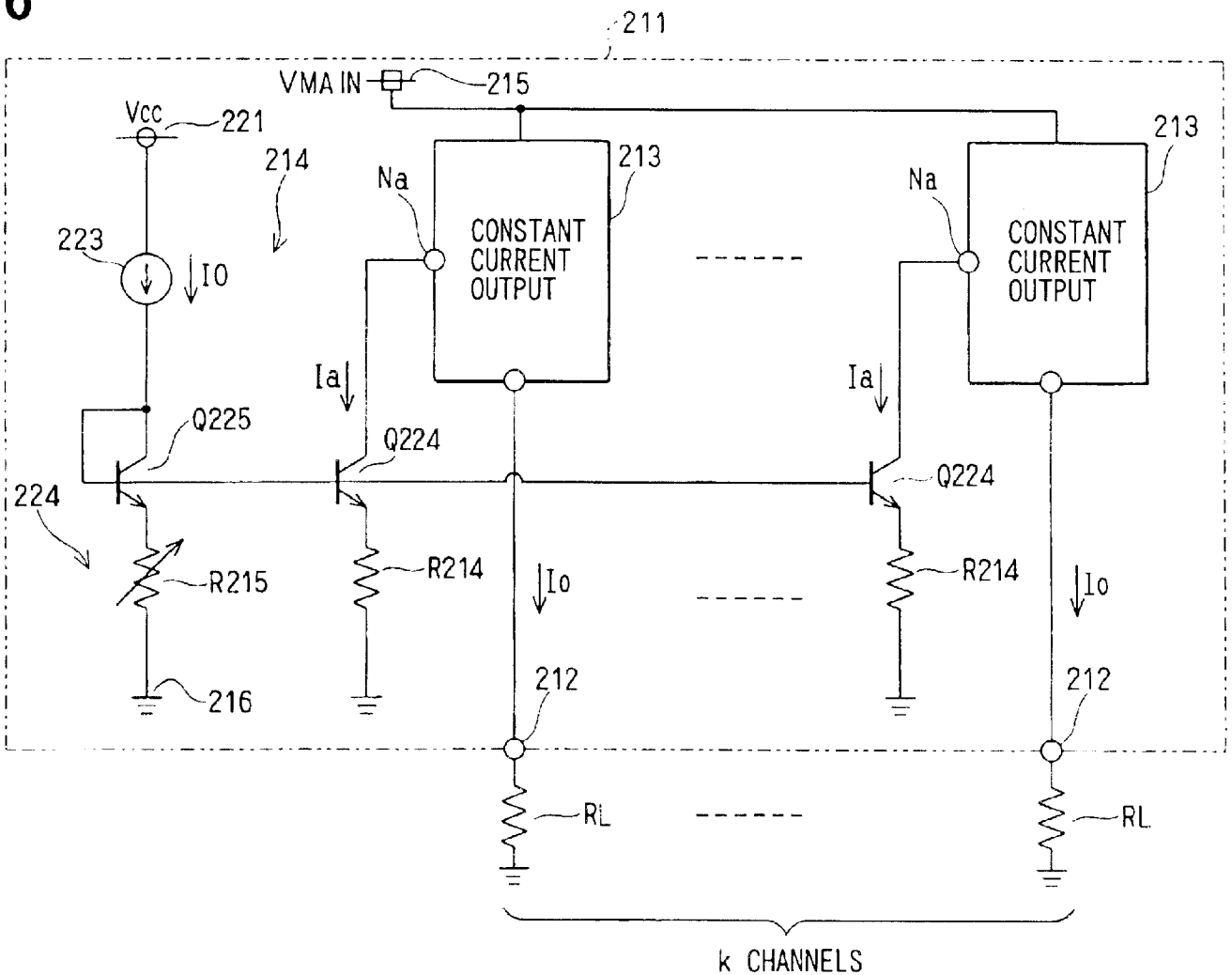
FIG. 6 is an electric circuit diagram showing a constant current supply device implemented by a third embodiment of the present invention.
Figure 7:
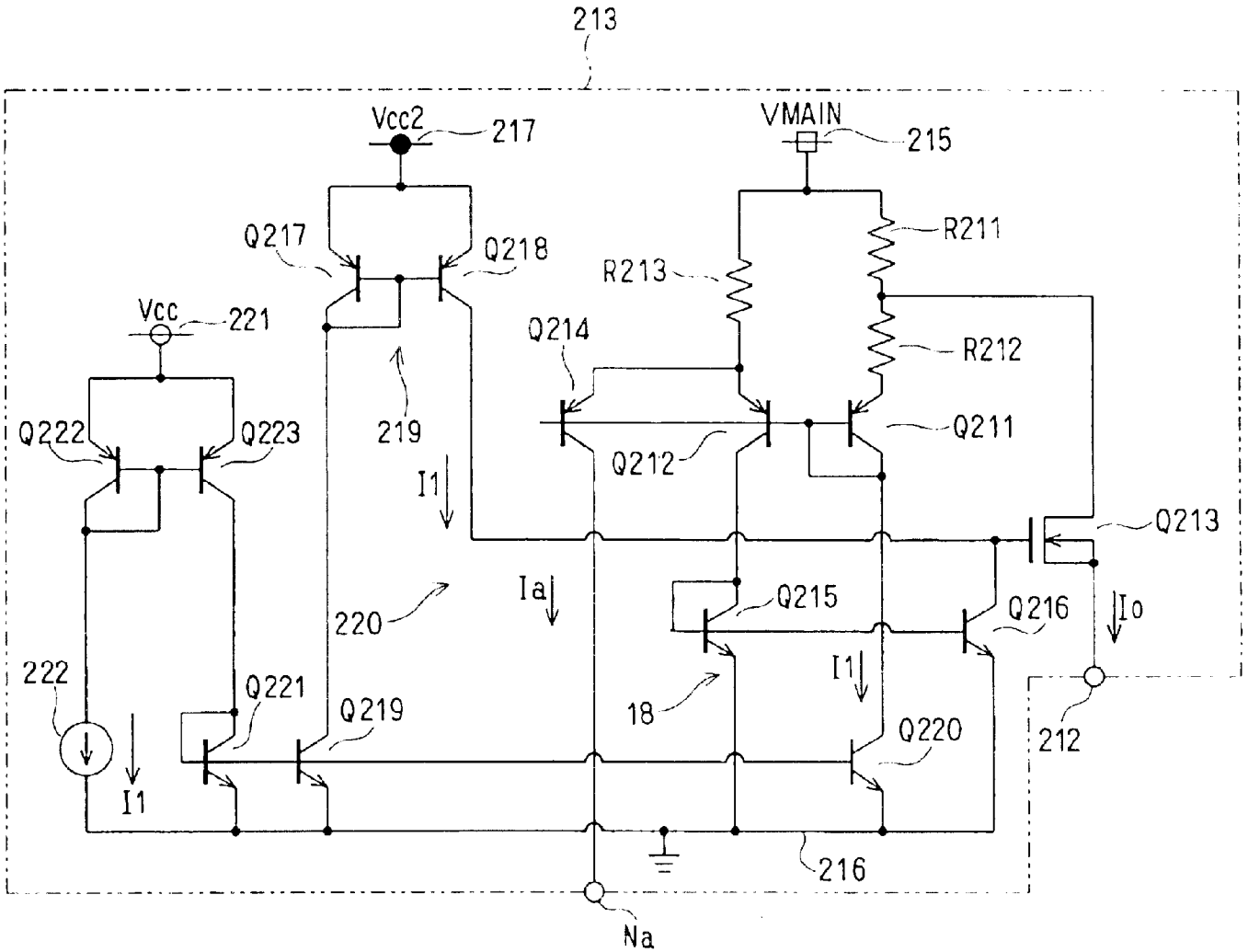
FIG. 7 is a detailed electric circuit diagram showing a constant current output circuit.

FIG. 6 is a diagram showing an electrical configuration of a constant current supply device (IC) 211 having a plurality of current output terminals 212 corresponding to k channels and a plurality of constant current output circuits 213 each provided for one of the current output terminals 212. FIG. 7 is a diagram showing a detailed electrical configuration of each of the constant current circuits 212.

As shown in FIG. 6, the IC 211 comprises k current output terminals 212 and k constant current output circuits 213 each used for outputting a constant current of typically 1.3 A to an external load RL connected to one of the current output terminals 212. The remaining circuit shown in FIG. 6 is an output current adjustment circuit 214.

As shown in FIG. 7, in the constant current output circuit 213, a power supply line 215 (first power supply line) for supplying a battery voltage VMAIN in the range 5.6 to 35 V is wired to the emitter of a PNP-type transistor Q211 (first transistor) by a resistor R211 (current detection resistor) and a resistor R212, which are connected to each other in series. The power supply line 215 is also wired to the emitter of a PNP-type transistor Q212 (second transistor) by a resistor R213. The base of the transistor Q211 is connected to the base of the transistor Q212 and the base of the transistor Q211 is connected to the collector of the transistor Q211 so that, as a whole, a circuit configuration identical with that of a current mirror circuit is formed. The resistors R211, R212 and R213 are each an Al (aluminum) shunt resistor.

A junction point between the resistors R211 and R212 is connected to the current output terminal 212 by a N-channel LDMOS transistor Q213 (third transistor) functioning as an output transistor. To be more specific, the source of the transistor Q213 is connected to the current output terminal 212 while the drain of the transistor Q213 is connected to the junction point. As a result, the resistor R211 for current detection use and the transistor Q213 are connected to each other in series between the power supply line 215 and the current output terminal 212.

A PNP-type transistor Q214 (fifth transistor) flows a portion of a feedback-control current flowing into the transistor Q212 to a node Na shown in the figure. The transistor Q214 is thus a component of the output current adjustment circuit 214. The base of the transistor Q214 is connected to the base of the transistor Q212 and the emitter of the transistor Q214 is connected to the emitter of the transistor Q212. The transistors Q214 and Q212 have a predetermined emitter area ratio.

A ground line 216 is connected to the emitters of NPN-type transistors Q215 and Q216, which form a current mirror circuit 218. A voltage Vcc2 obtained as a result of a boosting operation carried out by a charge pump circuit to a level in the range 15V to 30V is supplied to a power supply line 217 connected to the emitters of PNP-type transistors Q217 and Q218, which form a current mirror circuit 219. The current mirror circuits 218 and 219 form a feedback control circuit 220. The collector of the transistor Q216 serves as an output-side node of the current mirror circuit 218 while the collector of the transistor Q218 serves as an output-side node of the current mirror circuit 219. These collectors are both connected to the gate of the transistor Q213.

The collector or the base of the transistor Q215 is a node on the input side of the current mirror circuit 218. The collector and base of the transistor Q215 are connected to the collector of the transistor Q212. On the other hand, the collector or the base of the transistor Q217 is a node on the input side of the current mirror circuit 219. A NPN-type transistor Q219 is connected between the ground line 216 and the collector as well as base of the transistor Q217. On the other hand, a NPN-type transistor Q219 is connected between the ground line 216 and the collector as well as base of the transistor Q211. The transistors Q219 and Q220 form a current mirror circuit in conjunction with the transistor Q221.

A voltage Vcc of 5V is supplied to a power supply line 221 connected to the emitters of transistors Q222 and Q223, which form a current mirror circuit. A constant current circuit 222 is connected between the ground line 216 and the collector (or the base) of the transistor Q222. The collector of a transistor Q223 is connected to the collector (and base) of the transistor Q221. By such a configuration, collector currents equal to a current I1 output by the constant current circuit 222 flow through the transistors Q217 to Q220. It is to be noted that the circuit comprising the constant current circuit 222 and the transistors Q221 to Q223 can also be provided as a circuit common to all the constant current output circuits 213.

As shown in FIG. 6, the collector of a NPN-type transistor Q224 (fourth transistor) is connected to the node Na to which the shunt current Ia is output. The emitter of the transistor Q224 is connected to the ground line 216 (second power supply line) by a resistor R214. The bases of the transistors Q224 each provided for one of the constant current output circuits 213 are connected to the base of a transistor Q225 (sixth transistor) to form a current mirror circuit. A constant current circuit 223 is connected between the collector of the transistor Q225 and a power supply line 221. The emitter of the transistor Q225 is connected to the ground line 216 by a trimmable resistor R215.

Some of these configuration components, i.e., the constant current circuit 223 as well as the resistors R214 and R215, form a reference current generation circuit 224 for flowing a reference current corresponding to the shunt current Ia. The reference current generation circuit 224 and the transistors Q214, Q224 and Q225 form the output current adjustment circuit 214. It is to be noted that the constant current circuit 223 generates a constant current on the basis of a voltage generated by a resistor potentiometer for dividing a voltage output by a band gap reference voltage circuit.

Figure 8:
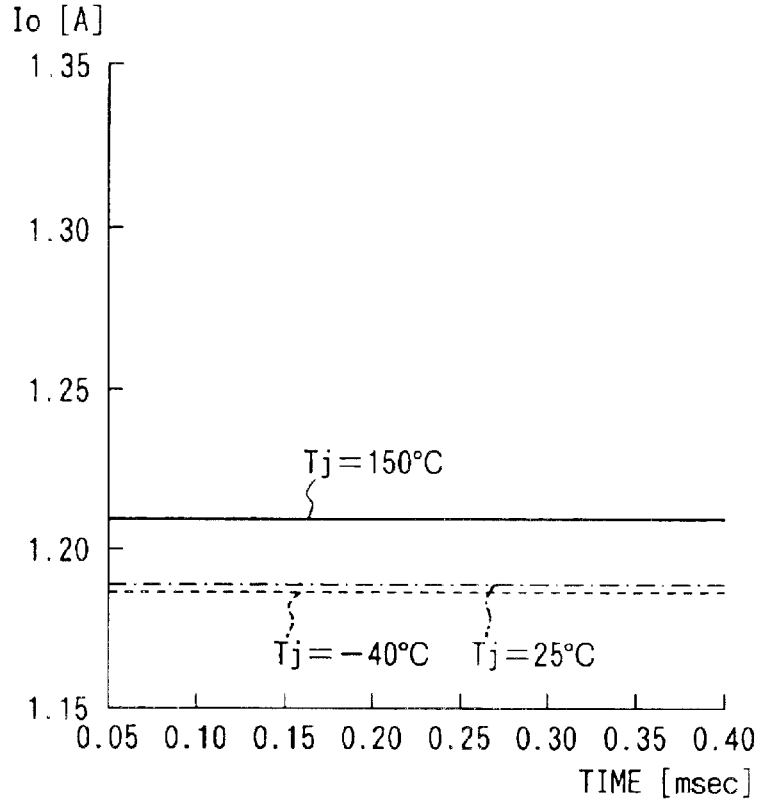
FIG. 8 is a diagram showing a simulation result of an output current for a case in which resistances are increased by 10%.
Figure 9:
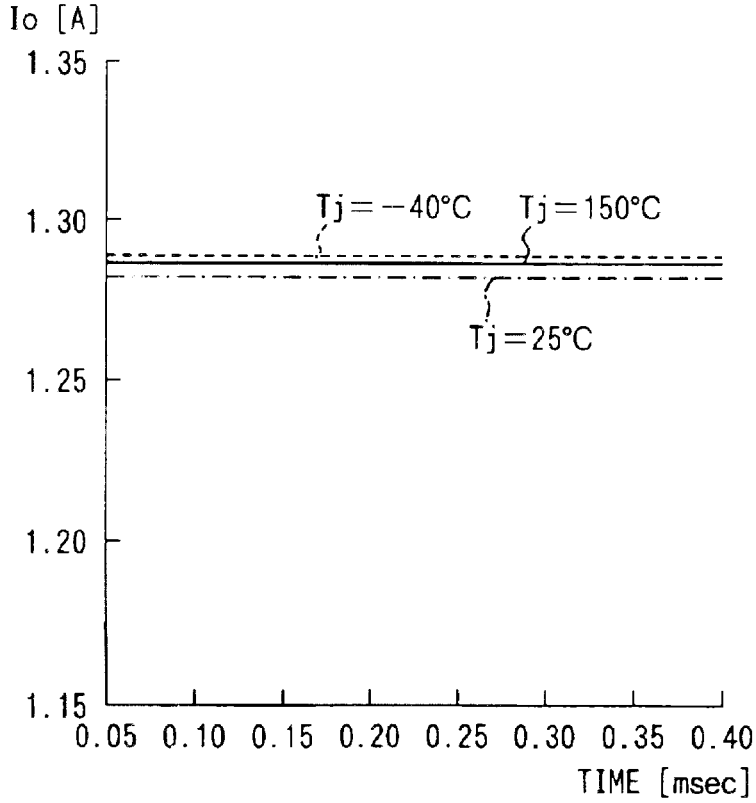
FIG. 9 is a diagram showing a post trimming simulation result of an output current as a result obtained by trimming only a resistor.
Figure 10:
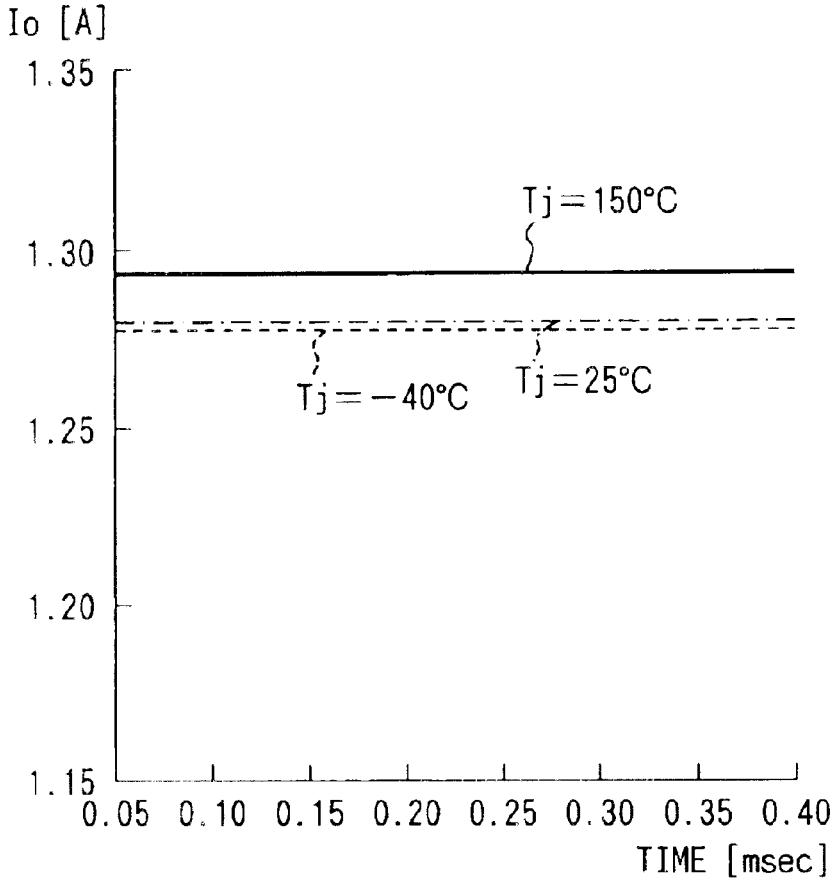
FIG. 10 is a diagram showing a post trimming simulation result of an output current as a result obtained by trimming an emitter area ratio.

Next, the operation of the third embodiment is explained by referring to FIGS. 8 to 10.

As described above, the constant bias current I1 flows through the transistors Q218 and Q220. Accordingly, the current I1 also flows through the transistor Q211. The power supply line 215 is connected to a battery, allowing the current Io to flow from the battery to the load RL by way of the power supply line 215, the resistor R211, the transistor Q213 and the output current terminal 212 of the IC 211.

It is assumed that the output current Io exceeds a predetermined target current magnitude. In this case, the voltage appearing between the two ends of the resistor R211 rises, causing the voltage appearing between the base and emitter of the transistor Q212 and, hence, the current flowing through the collector of the transistor Q212 to increase. The current flowing through the collector of the transistor Q212 flows to the current mirror circuit 218, which comprises the transistors Q215 and Q216. Since the constant current I1 flows to the current mirror circuit 219 comprising the transistors Q217 and Q218, on the other hand, the increase of the current flowing through the collector of the transistor Q212 reduces the voltage appearing between the gate and source of the transistor Q213 as a result of the negative feedback control. This negative feedback control restores the current flowing through the drain of the transistor Q213, that is, the output current Io, to the target magnitude.

This effect is considered quantitatively as follows assuming that symbol Ic(Q211) denote a current flowing through the collector of the transistor Q211. In this case, a voltage V(R211) appearing between the two ends of the resistor R211 is expressed by Eq. (1), whereas a voltage V(R212) appearing between the two ends of the resistor R212 is expressed by Eq. (2) as follows:

$$V(R211)=(Ic(Q211)+Io)\times R211 \quad (1)$$

$$V(R212)=Ic(Q211)\times R212 \quad (2)$$

In addition, it is assumed that the shunt current Ia flowing through the transistor Q214 has a magnitude of 0, that is, the transistor Q214 does not exist as is the case with the configuration of the related art, and symbol Ic (Q212) denote the current flowing through the collector of the transistor Q212. In this case, the voltage appearing between the two ends of the resistor R213 is expressed by Eq. (3) as follows.

$$V(R213)=Ic(Q212)\times R213 \quad (3)$$

It is assumed that symbol VBE(Q211) denote the voltage appearing between the base and emitter of the transistor Q211, whereas symbol VBE(Q212) denote the voltage appearing between the base and emitter of the transistor Q212. In this case, the voltage VBE(Q211) applied to the transistor Q211 and the voltage VBE(Q212) applied to the transistor Q212 satisfy a relation expressed by Eq. (4) as follows:

$$V(R211)+V(R212)+VBE(Q211)=V(R213)+VBE(Q212) \quad (4)$$

Substituting Eqs. (1) to (3) to Eq. (4) for V(R211), V(R212) and V(R213) respectively yields Eq. (5) as follows:

$$(Ic(Q211)+Io)\times R211+Ic(Q211)\times R212+VBE(Q211)=Ic(Q212)\times R213+V(R213) \quad (5)$$

It is assumed that the ratio of the area of the emitter of the transistor Q211 to the area of the emitter of the transistor Q212 is m:1. In this case, the output current Io is expressed by Eq. (6) as follows.

$$Io=VT/R211\times In(Ic(Q212)/Ic(Q211)\times m)+(Ic(Q212)\times R213-Ic(Q211)\times(R211+R212))/R211 \quad (6)$$

Symbol VT used in the above equation satisfies the equation VT=kT/q, where symbol k is the Boltzmann constant, symbol T is an absolute temperature and symbol q is the elementary charge.

When the output current Io used as a target cannot be attained due to process dispersions, the work of aggregated current adjustment needs to be done by carrying out typically an adjustment process. Symbols R211, R212 and R213 used in Eq. (6) represent the resistances of respective resistors R211, R212 and R213, which are each an Al wire resistor so that a trimming process cannot be carried out on those resistors. Thus, a trimming process can be applied to the emitter area ratio m and the ratio Ic(Q212)/Ic(Q211). The work to carry out a trimming process on the emitter area ratio m for all channels is very cumbersome.

In order to solve this problem, in this embodiment, a portion of the current Ic(Q212) flowing through the collector of the transistor Q212 is diverted to flow into the transistor Q214 as the current Ia subtracted from the current Ic(Q212) so that the ratio Ic(Q212)/Ic(Q211) can be adjusted to a variable value to trim the shunt current Ia collectively for all channels. The magnitude of the shunt current Ia is determined by the output current adjustment circuit 214.

More specifically, the transistor Q224 through which the shunt current Ia flows from the constant current output circuits 213 of all channels forms a current mirror circuit in conjunction with the transistor Q225. By trimming a resistor provided at one location as a resistor connected to the transistor Q225, the shunt current Ia flowing through the transistor Q224 common to all channels can be changed in an aggregated manner for all the channels.

FIGS. 8 to 10 are each a diagram showing a result of simulation. The results of simulation were computed under conditions including a voltage Vcc of 5 V, a boosted voltage Vcc2 of 28 V, a battery voltage VMAIN of 18 V, a target output current of 1.3 A as well as junction temperatures of −40 degrees Celsius corresponding to the dashed line shown in the figure, 25 degrees Celsius corresponding to the dot-and-dash line shown in the figure and 150 degrees Celsius corresponding to the solid line shown in the figure.

FIG. 8 shows pre-trimming magnitudes of the output current Io with the resistances of all resistors in the constant current output circuit 213 increased from their predetermined values by +10% on the assumption of the existence of process dispersions. FIG. 9 shows post-trimming magnitudes of the output current Io, which were attained under the same condition as FIG. 8 except that the resistor R215 of the output current adjustment circuit 214 was trimmed. FIG. 10 shows post-trimming magnitudes of the output current Io, which were attained under the same pre-trimming condition except that the emitter area ratio m was trimmed for all channels.

When the resistances of all the resistors are increased from their predetermined values by +10%, the output current Io decreases from the target magnitude of 1.3 A to 1.2 A as shown in FIG. 8. By merely trimming the resistor R215 provided at one location, however, the output currents Io for all channels can be adjusted to about 1.3 A without regard to whether the junction temperatures are high or low as is obvious from FIG. 9. The simulation result shown in FIG. 9 indicates that trimming of the resistor R215 provided at only one location is a trimming process having precision at least the same as that of the process carried out on the conventional circuit to trim the emitter area ratios m for all channels as shown in FIG. 10.

As described above, this embodiment implementing the IC 211 including the constant current output circuits 213 for a plurality of channels is characterized in that the IC 211 has a configuration employing the additional output current adjustment circuit 214. The output current adjustment circuit 214 has the transistor Q224 for shunting a portion of a current flowing through the transistor Q212 employed in each of the constant current output circuits 213. In the configuration, the shunt current Ia and, hence, the output current Io, are changed as a single quantity. Thus, the aggregated current adjustment for the constant current output circuits 213 can be carried out with ease and the time it takes to carry out the aggregated current adjustment can be shortened.

In addition, neither resistor for resistance adjustment nor transistor for emitter area adjustment is required for each of the constant current output circuits 213. Thus, the circuit scale (or the layout size) can be reduced to a value smaller than that of the conventional configuration. As a result, the cost can be further decreased.

In this case, for the transistor Q212, the transistor Q214 is added with the base and emitter of the transistor Q214 connected to respectively the base and emitter of the transistor Q212. Since the shunt current Ia is flown to the transistor Q224 by way of the transistor Q214, mutual interference of the constant current output circuit 213 and the output current adjustment circuit 214 can be suppressed.

In addition, the output node of the current mirror circuit 218 inputting a current flowing through the collector of the transistor Q212 and the output node of the current mirror circuit 219 inputting a constant current are connected to the gate of the transistor Q213 to form the feedback control circuit 220 having a high gain. Thus, the output current Io can be adjusted in follow-up control to a target magnitude with a high degree of precision without regard to changes in power supply voltage and changes in load.

(Fourth Embodiment)

Figure 11:
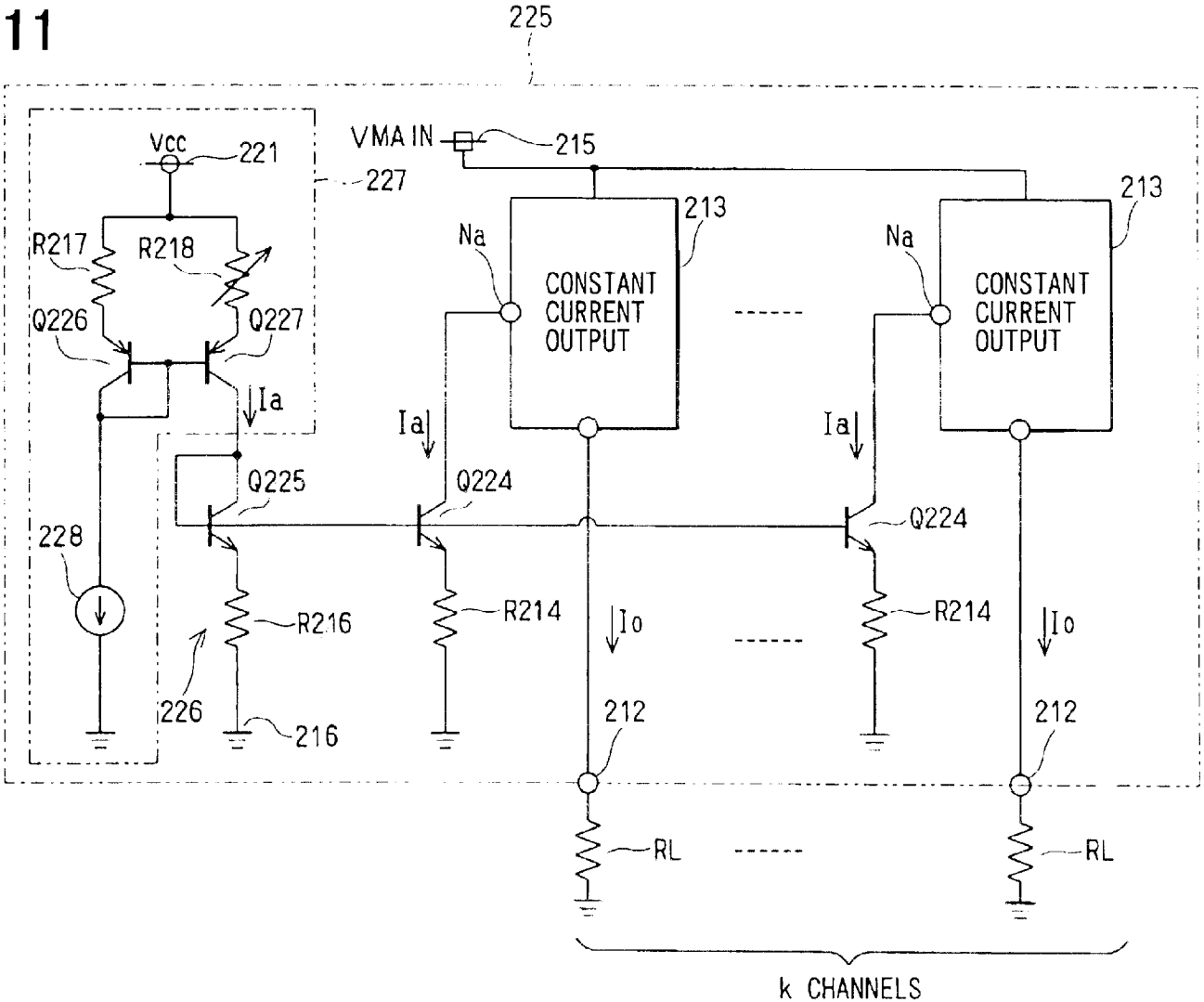
FIG. 11 is an electric circuit diagram showing a constant current supply device implemented by a fourth embodiment of the present invention.

As shown in FIG. 11, an IC 225 comprises a plurality of constant current output circuits 213. As with the IC 211, the IC 225 comprises k current output terminals 212, k constant current output circuits 213 each used for outputting a constant current of typically 1.3 A to an external load RL connected to one of the current output terminals 212 and an output current adjustment circuit 226.

The output current adjustment circuit 226 comprises transistors Q214, Q224 and Q225 as well as a reference current generation circuit 227. The transistors Q224 and Q225 form a current mirror circuit. The emitter of the transistor Q225 is connected to the ground line 216 by a fixed resistor R216. In this configuration, the emitter area ratio of the transistor Q224 is equal to that of the transistor Q225 and the resistance of the resistor R214 is exactly equal to that of a resistor R216.

The reference current generation circuit 227 is a constant current circuit that can be subjected to a current adjusting process. The reference current generation circuit 227 comprises a current mirror circuit, a resistor R217, a trimmable resistor R218 and a constant current circuit 228. The current mirror circuit comprises PNP-type transistors Q226 and Q227. The resistor R217 is connected between the emitter of the transistor Q226 and a power supply line 221. The resistor R218 is connected between the emitter of the transistor Q227 and the power supply line 221. The constant current circuit 228 is connected between the collector of the transistor Q226 and the ground line 216. The collector of the transistor Q227 connected to the collector of the transistor Q225 serves as an output node of the reference current generation circuit 227.

In this configuration, when the resistor R218 is subjected to a laser trimming process, the current flowing through the transistor Q225 can be changed. Thus, the shunt currents Ia each flowing through the transistor Q224 provided for one of the constant current output circuits 213 can be varied by the same magnitude. As a result, this embodiment also exhibits the same effects as the third embodiment.

In the third and fourth embodiments, the transistor Q214 can be eliminated to connect the collector of the transistor Q215 directly to the collector of the transistor Q224. In addition, the resistors R212 and R213 can also be eliminated.

The third embodiment can have a configuration in which a fixed resistor can be employed as the resistor R215 and the transistor Q225 can have a trimmable emitter area.

In the fourth embodiment, the emitter area ratios of the transistors Q224 can also be made different from each other, and the emitter area ratio of each of the transistors Q224 can also be made different from that of the transistor Q225. Similarly, the resistances of the resistors R214 can also be made different from each other, and the resistance of each of the resistors R214 can also be made different from the resistance of the resistor R216. In these cases, when the resistor R218 is trimmed, the shunt currents Ia of the channels are all changed in accordance with a ratio determined by the emitter area ratios or the resistances. In addition, the resistors R214 and R216 can be eliminated.

As the trimming method, a Zener-zap-trimming technique or a fusion cutting trimming technique can be adopted.

The transistors can each be a bipolar transistor or an FET, whereas the ICs 21 and 25 can each have a configuration comprising bipolar, CMOS and BiCMOS circuits.

What is claimed is:

1. A constant current supply device comprising:

a first current mirror circuit including a first transistor, a second transistor and a current detection resistor provided between an emitter of the first transistor and a current output terminal;

a main transistor provided on a main current path starting from the current output terminal, passing through the current detection resistor and ending at a first power supply line;

a first constant current circuit connected between a collector of the first transistor and the first power supply line as a constant current circuit for generating a constant current on the basis of a voltage appearing between a base and emitter of a transistor;

a second constant current circuit; and a second current mirror circuit including a third transistor connected between a collector of the second transistor and the first power supply line, a fourth transistor connected between the second constant current circuit and the first power supply line, and a first compensation resistor connected between an emitter of the third transistor and the first power supply line and having a positive temperature coefficient, wherein a collector of the fourth transistor is connected to a base of the main transistor.

2. A constant current supply device according to claim 1, wherein the second constant current circuit includes:

a third constant current circuit for generating a constant current on the basis of a voltage appearing between a base and emitter of a transistor; and a third current mirror circuit having a fifth transistor connected between the third constant current circuit and a second power supply line and a sixth transistor connected between a collector of the fourth transistor and the second power supply line; and a second compensation resistor having a positive temperature coefficient connected between an emitter of the sixth transistor and the second power supply line to be used in conjunction with the first compensation resistor.

3. A constant current supply device according to claim 1, wherein the first constant current circuit is associated with any of the other constant current circuits by using a current mirror circuit.

4. A constant current supply device according to claim 1, further comprising:

a feedback resistor connected between an emitter of the main transistor and the first power supply line.

5. A constant current supply device according to claim 1, further comprising:

a first resistor provided between the current detection resistor and the emitter of the first transistor; and a second resistor provided between the current output terminal and an emitter of the second transistor.

6. A constant current supply device according to claim 5, wherein the current detection resistor, the first resistor and the second resistor are each an aluminum wire resistor.

7. A constant current supply device comprising:

a first current mirror circuit including a first transistor, a second transistor and a current detection resistor provided between an emitter of the first transistor and a current output terminal;

a main transistor provided on a main current path starting from the current output terminal, passing through the current detection resistor and ending at a first power supply line;

a first constant current circuit connected between a collector of the first transistor and the first power supply line as a constant current circuit for generating a constant current on the basis of a voltage appearing between a base and emitter of a transistor;

a second constant current circuit; and a second current mirror circuit including a third transistor connected between a collector of the second transistor and the first power supply line, and a fourth transistor connected between the second constant current circuit and the first power supply line, wherein a collector of the fourth transistor is connected to a base of the main transistor, wherein the second constant current circuit includes a third constant current circuit for generating a constant current on the basis of a voltage appearing between a base and emitter of a transistor; and a third current mirror circuit having a fifth transistor connected between the third constant current circuit and a second power supply line, a sixth transistor connected between a collector of the fourth transistor and the second power supply line, and a compensation resistor having a positive temperature coefficient and connected between an emitter of the sixth transistor and the second power supply line.

8. A constant current supply device according to claim 7, wherein the first constant current circuit is associated with any of the other constant current circuits by using a current mirror circuit.

9. A constant current supply device according to claim 7, further comprising:

a feedback resistor connected between an emitter of the main transistor and the first power supply line.

10. A constant current supply device according to claim 7, further comprising:

a first resistor provided between the current detection resistor and the emitter of the first transistor; and a second resistor provided between the current output terminal and an emitter of the second transistor, wherein the current detection resistor, the first resistor and the second resistor are each an aluminum wire resistor.

11. A constant current supply device comprising:

a plurality of current output terminals;

a plurality of constant current output circuits each provided for one of the current output terminals, wherein each of the constant current output circuits includes a first transistor having its base and collector connected to each other, a current detection resistor connected between a first power supply line and an emitter of the first transistor, a second transistor having a base connected to a base of the first transistor and an emitter connected to the first power supply line, a third transistor connected in series to the current detection resistor to form a series circuit between the first power supply line and the current output terminal, and a feedback control circuit for executing control to reduce a voltage appearing between a gate and source of the third transistor in accordance with an increase of a current flowing through the second transistor; and an output current adjustment circuit having fourth transistors each provided for one of the constant current output circuits as a shunting transistor for dispersing a portion of a current flowing through the second transistor to generate a shunt current and used for changing currents flowing through the fourth transistors provided for the constant current output circuits in common.

12. A constant current supply device according to claim 11, wherein the output current adjustment circuit has a fifth transistor for each particular one of the constant current output circuits, the fifth transistor having base and emitter connected to respectively a base and emitter of the second transistor employed in the particular constant current output circuit, and serving as a shunt transistor for flowing a shunt current to the fourth transistor provided for the particular constant current output circuit.

13. A constant current supply device according to claim 11, wherein the output current adjustment circuit has:

a sixth transistor common to the fourth transistors provided for the constant current output circuits; and a reference current generation circuit for flowing an adjustable reference current corresponding to the shunt current into the sixth transistor, and wherein the fourth transistors provided for the constant current output circuits are connected to form a current mirror circuit in conjunction with the sixth transistor.

14. A constant current supply device according to claim 13, wherein the reference current generation circuit has:

a resistor provided for each particular one of the constant current output circuits as a resistor connected between a second power supply line and an emitter of the fourth transistor provided for the particular constant current output circuit;

a constant current circuit connected to a collector of the sixth transistor; and a trimmable resistor provided between the second power supply line and an emitter of the sixth transistor.

15. A constant current supply device according to claim 13, wherein the reference current generation circuit has a constant current circuit connected to a collector of the sixth transistor as a constant current circuit that can be subjected to a current adjusting process.

16. A constant current supply device according to claim 11, wherein the feedback control circuit has two current mirror circuits connected to each other in series to form a configuration in which output-node-side transistors of the two current mirror circuits sandwich a gate of the third transistor.

17. A constant current supply device according to claim 16, wherein one of the two current mirror circuits inputs a current flowing through a collector of the second transistor.

18. A constant current supply device according to claim 17, wherein the other one of the two current mirror circuits inputs a predetermined constant current.

* * * * *